United States Patent [19]

Levine

[11] Patent Number: 4,741,540

[45] Date of Patent: May 3, 1988

[54] LOTTERY NUMBERS SELECTOR GAME

[75] Inventor: Sidney Levine, St. Louis, Mo.

[73] Assignee: Sidney Levine Co. Inc., Florissant, Mo.

[21] Appl. No.: 44,601

[22] Filed: May 1, 1987

[51] Int. Cl.[4] ..... A63F 1/04

[52] U.S. Cl. ..... 273/292; 273/138 R; 273/141 R; 273/296

[58] Field of Search ..... 273/138 R, 141 R, 292, 273/296

[56] References Cited

U.S. PATENT DOCUMENTS 1,484,564 2/1924 Riffert ..... 273/292

4,591,162 5/1986 Fakhoury ..... 273/303

*Primary Examiner*—Anton O. Oechsle

*Attorney, Agent, or Firm*—Kalish & Gilster

[57] ABSTRACT

A lottery numbers selector game which comprises an assemblage of card-like components; there being three different types of such, namely numeral cards each bearing a numeral within a predetermined range; a second group of cards which are of such quantity as when added to the first group will provide a total divisible by a predetermined divisor so as to present a number of rows of cards of like number. A second group of cards are distinctly identified and non-numerical bearing so as to readily permit elimination from game consideration of those rows containing any such members of the second group. There is provided a third type card which is single in number and serves as a determinator, bearing a message as by printing or the like for indicating to the player a particular row of numeral-bearing cards for selection. Each such non-eliminated row thus contains that number of numeral-bearing cards which correspond to the number of numerals in the particular lottery involved and present the numerals of the non-selected row in a random fashion.

5 Claims, 1 Drawing Sheet

A
b
a
1
THROUGH
39 c
FLIP CARD
BET HAND WITH HIGHEST CARD
d
BET HAND WITH LOWEST CARD
e a
2
LOTTO CARDS
FLIP CARD
c b
a
2
J a
1
26
2
22
38
33
11
21
13
3
27
10
32
20
15
9
36
5
37
7
24
29
1
39
31 c
d
FLIP CARD
BET HAND WITH HIGHEST CARD
FLIP CARD
BET HAND WITH LOWEST CARD
e

LOTTERY NUMBERS SELECTOR GAME

BACKGROUND AND SUMMARY OF THE INVENTION

This invention relates in general to games of chance and, particularly, to a game for objectively determining an arbitrary sequence of numbers such as for submission in lotteries.

In recent years various States have elected to follow a practice, long indulged in by various foreign countries, in establishing lotteries for enhancing the State's revenue. Thus an individual desiring to participate in any such lottery will submit a random sequence of numbers together with the prescribed fee in the hope that such sequence will coincide in all respects with the particular "winning" numbers drawn by the lottery operators. Normally, the component numbers involved are either single or double digit and with the latter being of a predetermined limit. Thus, for example, in one State the highest number may be 39 whereas in another State the corresponding highest number may be 44. The range of numbers will vary from State to State, but there is, understandably, a cap upon the particular range so that the possible combinations are not of such infinitude as to utterly destroy the gambling instinct of the normally speculative participant.

Since the particular combination of numbers and the sequential arrangement of the same in the winning combination, are determined quite fortuitously, the average player will engage in his or her own peculiar technique for arriving at a series for betting purposes. Individuals may utilize a sequence combining numbers in the years of birth of their offspring or of other relations or of particular events in their life; or may select numbers which have some peculiar relationship to sporting events or to professional players; etc. Admittedly, the motivations for selections of any series of numbers by an individual defy the imagination, but it would conclusively appear that such a combination has been subjectively determined even though in many instances entirely unconsciously motivated. This exercise, if practiced with some continuity so as to avail oneself of each of the periodic lotteries available, becomes somewhat onerous and may be productive, after a while, of a substantial sense of exasperation.

Therefore, it is an object of the present invention to provide a game whereby a sequence of numbers compatible with that utilized in the preselected lottery may be provided without the exercise of subjective determination by the player.

It is a further object of the present invention to provide a game of the character stated which is adapted for coincidence with the particular lottery to be played so that the resulting number arrangement provided will coincide with the regulations of such lottery.

It is still further an object of the present invention to provide a game of the character stated which comprehends an assemblage of individual components which may be easily manipulated; are lightweight; and require minimal space for storage.

It is a still further object of the present invention to provide a game of the character stated which comprises a multiplicity of discrete cardlike components which may be used in accordance with a prearranged procedure for visually presenting a chance combination of numbers for lottery usage and thereby obviate the necessity of an individual having to subjectively contrive a combination through conscious cerebral activity.

It is another object of the present invention to provide a game of the character stated which comprises components which may be most economically produced; which may be utilized for the intended purpose without developed skill on the part of the player; and the use of which does provide a source of amusement and interest.

DESCRIPTION OF THE PREFERRED EMBODIMENT

Figure 1:
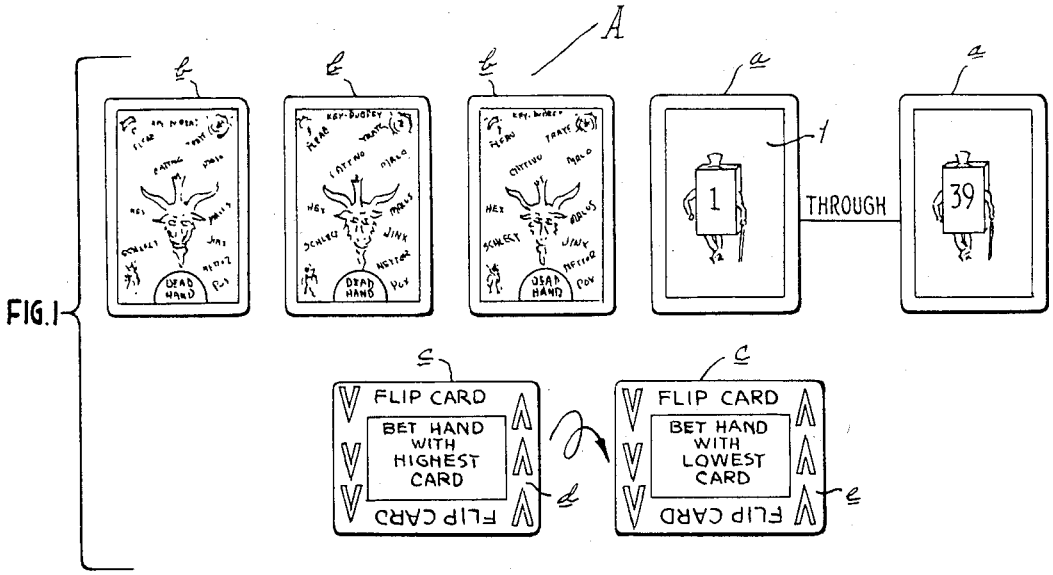
FIG. 1 is a composite view of the obverse or game-effective faces of the components of a lottery numbers selector game constructed in accordance with and embodying the present invention.

Referring now by reference numerals to the drawing, A generally designates, collectively, components for playing the lottery numbers selector game of the present invention. Each of said components is, in effect, of a card-like character which may approximate in dimension and size the normal everyday playing card so as to be lightweight and easily manipulable.

Figure 2:
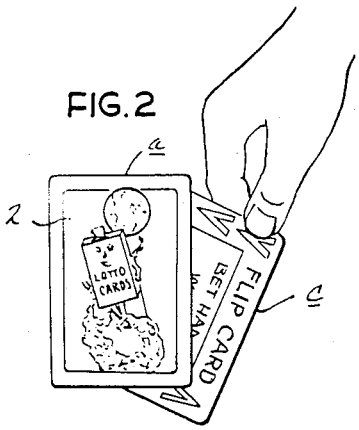
FIG. 2 illustrates the reverse or decorative side of the components shown in FIG. 1.

These cards are of three fundamental types: Cards a each have a playing, or obverse, game-effective face 1 and a reverse or nonplaying face 2 which latter may bear any suitable ornamentation or graphic design for esthetic purposes; one such design being presented in FIG. 2. Cards a correspond in number with that particular numerical range adopted by the particular lottery for which a number combination is to be determined. Thus, as shown, cards a will be 39 in number with each carrying a sequential numeral upon its face 1 since the highest number, as the number 39, is the highest number for the particular lottery involved. A plurality of rejector or row-eliminating cards b are provided with the number thereof being such that when added to the 39 cards a will provide the nearest total divisible by that number which corresponds to the number of numerals in the sequence permitted by the particular lottery for which a sequence is sought. So that for illustration, if such lottery permits 6 numerals then three such cards b will be provided to present with the 39 cards a, a total of 42 which is the next number above 39 equally divisible by 6. This particular parameter is utilized so as to correspond to the number of numerals in each combination prescribed by the particular lottery. Thus, by reason of further clarification, if the lottery to be played permitted a numeral range from 1 to 44, then there would be 44 cards a together with four rejector cards b with the total being thereby 48 which is the next number above 44 divisible by 6. Of course, if the lottery involved permitted a high of 44, but called for a sequence of seven numerals then five cards b would be added to total 49, the next number equally divisible by 7. Thus the number of rejector cards b is determined by the lottery's highest number and the number of numerals in the allowed sequence.

The present game also includes a single determinator or so-called "flip" card c. This card possesses suitable inscription on each of its faces for instructing the user in making the ultimate number combination selection as will be more fully set forth hereinbelow. But it should be recognized that there is but a single determinator card c regardless of the particular number of cards a and b. Rejector cards b may carry any desired design on its faces for assuring of ready visual distinction between same and cards a. It is preferable that rejector cards b do not bear a numeral so as to avoid any confusion with cards a. .

In utilizing the cards A of the present invention for playing the game for lottery numeral selection, card c is withdrawn or placed aside and cards a and b are placed in stacked form and then shuffled in the normal manner to intermingle the cards so that the resultant stacked sequence or arrangement prior to dealing is entirely fortuitous or accidental.

Figure 3:
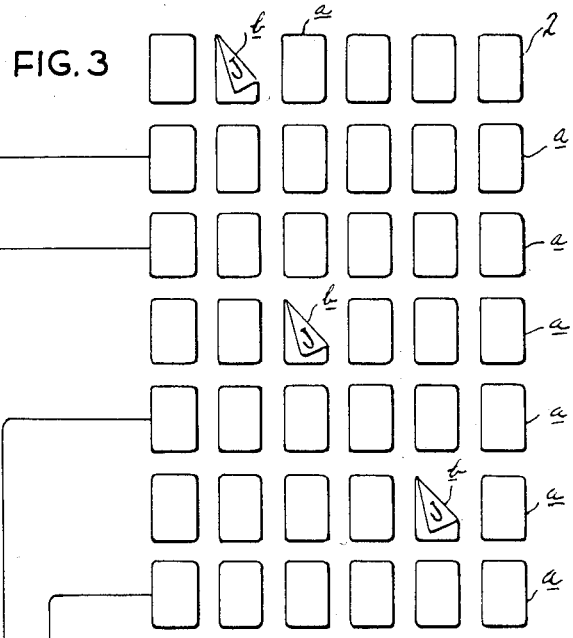
FIG. 3 is a plan view illustrating the game components in a fully dealt or initial game stage disposition, with the reverse sides exposed and with the rejector components being in a partially turned-back state.
Figure 4:
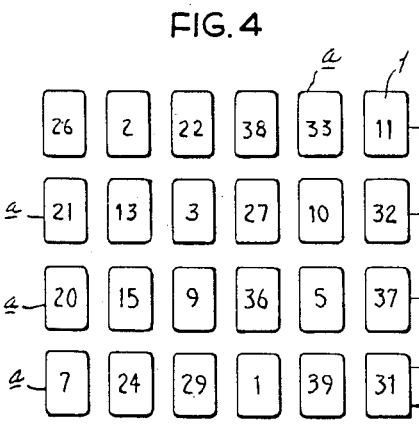
FIG. 4 is a plan view illustrating the components with the face-effective sides thereof presented for visual review and being indicated, through diagramatic connecting lines such as those rows shown in FIG. 3 in which a rejector component was absent.

The dealer then with the deck presented so that the obverse sides 1 of cards a are directed downwardly and hence abscured from view, deals the cards for disposition upon a suitable surface, such as a table or otherwise, with the said sides 1 downwardly and with the cards being placed in discrete rows of that number corresponding to the number in the particular lottery numeral sequence. Thus, for example only, cards a and b are shown as in rows of 6. Since the total deck of cards a and rejector cards b is 42, in the present example, there will, understandably, be 7 rows of 6 cards as illustrated in FIG. 3. With the cards so disposed, the rejector cards b by reason of their differentiation in design, coloration, ornamentation, or the like, from cards a, will be readily apparent, as such has been schematically indicated in FIG. 3. The player will then withdraw cards a and b in those rows which contain one or more of rejectors b and hence remove same from further consideration. In FIG. 3 the three rejector cards b are presented as being in three different rows but it is quite possible that there might be more than one in any one particular row. In any event, the rows containing same are, as it were, rejected from play, thereby leaving the remaining rows consisting solely of cards a for game purposes. The cards a in each of such non-rejected rows will have been turned upwardly so that the obverse numeral-bearing or game-effective side of each is fully exposed, as in the manner indicated in FIG. 4. It will thus be seen that each of such rows contain numerals in an entirely indiscriminate, accidental sequence so that theoretically four groups of six numerals which would comply with the lottery regulations are provided.

Figure 5:
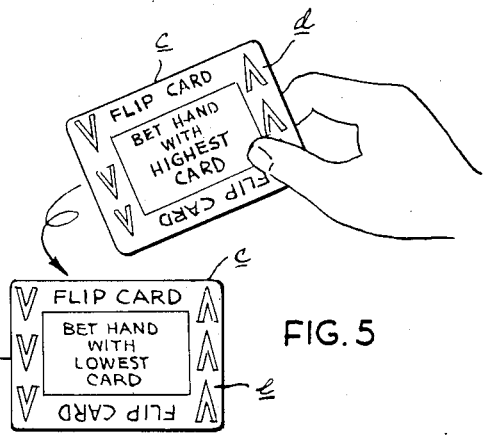
FIG. 5 is a top plan view illustrating one side of the determinator card and with its relationship to a particular combination in FIG. 4 being indicated by an arrow.

Thereupon, the player grasps the determinator card c and by a flipping motion releases same from a point elevated above the playing surface so that the same may drop and land to expose one face or the other. As is evident in FIG. 1 one side face d of determinator card c carries the expression "Bet hand with highest card" while the opposite face e thereof has imprinted thereon the expression "Bet hand with lowest card". Thus after the flipping exercise, one face d or the other e will be directed upwardly for legibility and the message thereon will direct the player to that exposed row of cards a which meet the particular directive. As shown, for example, in FIG. 5, the determinator card c has landed with the side d bearing the message "Bet hand with lowest card" presented upwardly. Thus, the player will then view the exposed, non-rejected rows of cards a (shown in FIG. 4) to find that row which carries a card bearing the lowest number. In the example shown, the bottom most row would qualify since it contains the card bearing the numeral "1". Obviously, in the event determinator card c landed with the opposite side c presented upwardly so that the user was directed to "Bet hand with highest card" he would understandably be directed to the same or lower most row of cards a since that row contains a card bearing the numeral "39" which as indicated is the highest numeral in this particular series. But it will be appreciated that this is quite coincidental since in all likelihood the lowest and the highest cards would most probably not be in the same row.

In view of the row selection brought about in the fashion above outlined, the player would then adopt that particular numeral sequence for submission to the lottery in the trust that such sequence would prove to coincide with the "lucky numbers" drawing the lottery.

It will thus be seen that in view of the foregoing the utilization of the cards a, b, and c of the present invention will be productive of an entirely arbitrary fortuitous sequence of numerals which in number and in range will conform to the regulations of the lottery to be played. Accordingly, the player is spared the necessity of having to develop some series of numbers which could entail substantial onerous mental preoccupation. The present game may be played in a matter of minutes and with the user being accorded a selection which he can present to the lottery with just as much assurance as any sequence he might contrive after considerable agitating deliberation.

It is quite evident that the present invention can be adapted for accomodating any peculiar numerical range and number of units in any particular combination as may be required by any lottery. So that if a greater numerical range than 1 to 39 is required, all one need do is provide cards a containing numbers within the particular range and then provide that number of rejector cards b which would permit the dealt rows to contain that number of units required. The example hereinabove discussed, with the rejector cards b being located in three distinct rows thus left a maximum of four rows to be potentials for ultimate choice. However, if desired, a greater number of rejector cards b could be used so as to allow of a lesser number of ultimate non-rejected rows for ultimate determination should such be desired, but, of course, keeping in mind the requisite number of the sequence.

It is self evident that determinator c could be functionally replaced by other indicating means such as, for instance, by a rotatable pointer mounted upon a suitable support so that after rotation it would point to a zone indicating selecting the row with the highest card or another zone indicating selecting the row with the lowest card. However, it will be appreciated that determinator C being in card form lends itself very conveniently to inclusion with the deck of cards A for facile storage and transportational purposes.

What is claimed is:

1. A lottery numeral selector game comprising a plurality of first stackable members, each first stackable member having an obverse and a reverse side, the number of said first stackable members being predetermined for corresponding to a preselected range, each first stackable member carrying a different number on the obverse side thereof within said preselected range, a plurality of second stackable members, each of said stackable members having an obverse and a reverse side, said second stackable members being non-numeral bearing, visually detectable means provided on each second stackable member productive of ready distinction between same and said first stackable members, said second stackable members being substantially reduced in number relative to said first stackable members and being of such quantity that when added to the number of said first stackable members will provide the nearest total equally divisible by a predetermined divisor whereby a multiplicity of groups of like number of said first and second stackable members may be provided, and means for selecting a group from those containing only said first stackable members.

2. A lottery selector game as defined in claim 1 and further characterized by said first and second stackable members being of like size and thickness for intermixture in stack-forming relationship and with the inner mixed first and second stackable members being in random sequence.

3. A lottery numeral selector game as defined in claim 2 and further characterized by said first and second stackable members being of relatively thin card-form.

4. A lottery numeral selector game as defined in claim 3 and further characterized by said means for selecting a group comprising a single card having an obverse and a reverse side, a directive message provided on both the obverse and the reverse side of said card, said directive messages being unalike.

5. A method for determining a number for submission in an extrinsic lottery game wherein the chance sequence of a predetermined number of numerals within a preselected range will be prize-eligible comprising an assemblage of first stackable members being quantitatively equal to the numbers in the lottery range, each first stackable member having an obverse and a reverse side and carrying a different number on the obverse side thereof within said predetermined range, providing a plurality of second stackable members each having an obverse and a reverse side, said second stackable members being non-numeral bearing and carrying visually detectable means for effecting ready distinction between same and said first stackable members, said second stackable members being of such quantity that when added to the quantity of said first stackable members will present the nearest total equally divisible by that number of numerals permitted within the lottery sequence, intermixing said first and second stackable members to provide a composite stack wherein the same are in random sequence, then distributing the members in said stack into rows of first and second stackable members corresponding in number to that permitted by the extrinsic lottery game, withdrawing each such row containing at least one second stackable member whereby the remaining rows contain only first stackable members, providing a determinator card-like component carrying a directive message on at least one side thereof, and then selecting that row of first stackable members compatible with the message on said at least one side of said determinator card-like component.

* * * * *